United States Patent [19]

Logan

[11] 4,432,916

[45] Feb. 21, 1984

[54] METHOD AND APPARATUS FOR THE ELECTROSTATIC ORIENTATION OF PARTICULATE MATERIALS

[75] Inventor: James D. Logan, Whitman County, Wash.

[73] Assignee: Morrison-Knudsen Forest Products Company, Inc., Boise, Id.

[21] Appl. No.: 339,404

[22] Filed: Jan. 15, 1982

[51] Int. Cl.[3] ..... B06B 1/02

[52] U.S. Cl. ..... 264/24; 264/108; 425/174.8 E

[58] Field of Search ..... 264/24, 23, 108, 518; 425/174.8 E; 19/303

[56] References Cited

U.S. PATENT DOCUMENTS

| | | | |
|---|---|---|---|
| 3,843,756 | 10/1974 | Talbott et al. | 264/24 |
| 3,954,364 | 5/1976 | Talbott et al. | 425/174.8 E |
| 4,111,294 | 9/1978 | Carpenter et al. | 264/24 |
| 4,113,812 | 9/1978 | Talbott et al. | 264/518 |
| 4,284,595 | 8/1981 | Peters et al. | 264/108 |
| 4,287,140 | 9/1981 | Peters et al. | 264/23 |
| 4,323,338 | 4/1982 | Peters et al. | 425/174.8 E |
| 4,347,202 | 8/1982 | Henckel et al. | 264/24 |

FOREIGN PATENT DOCUMENTS

| | | |
|---|---|---|
| 2405994 | 8/1975 | Fed. Rep. of Germany . |
| 400223 | 1/1978 | Sweden . |

*Primary Examiner*—Jay H. Woo

*Attorney, Agent, or Firm*—Seed and Berry

[57] ABSTRACT

Discrete elongated pieces of material are electrostatically oriented by cascading a multitude of such pieces through an orienting zone for deposit as a mat on an insulating belt or mat-support surface. An electrical current is passed through the mat to produce a directional electric field immediately above the mat parallel to the electric field of the orienting zone. Distortions in the electric field which result as the thickness of the mat increases or as the width of the orientation cell is reduced are avoided by varying the strength of the electric field along the length of the mat being formed to achieve a surface potential distribution (electric field) at the upper surface of the mat in the mat-forming zone which is essentially equal to the electric potential distribution between the vertically charged plates of the orienting zone.

16 Claims, 8 Drawing Figures

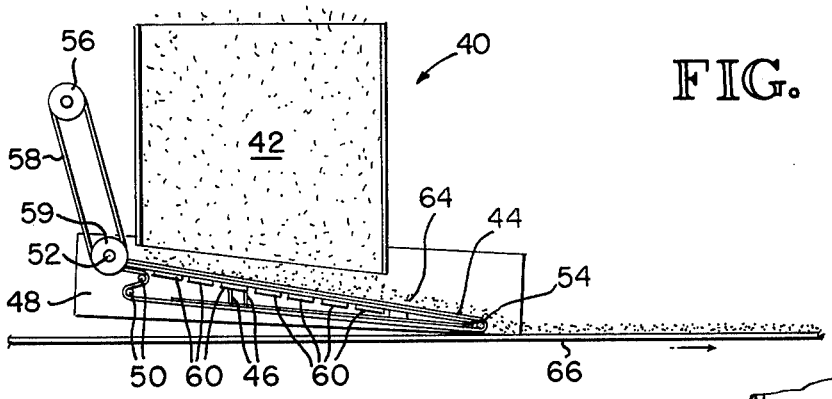
FIG. 3
FIG. 4
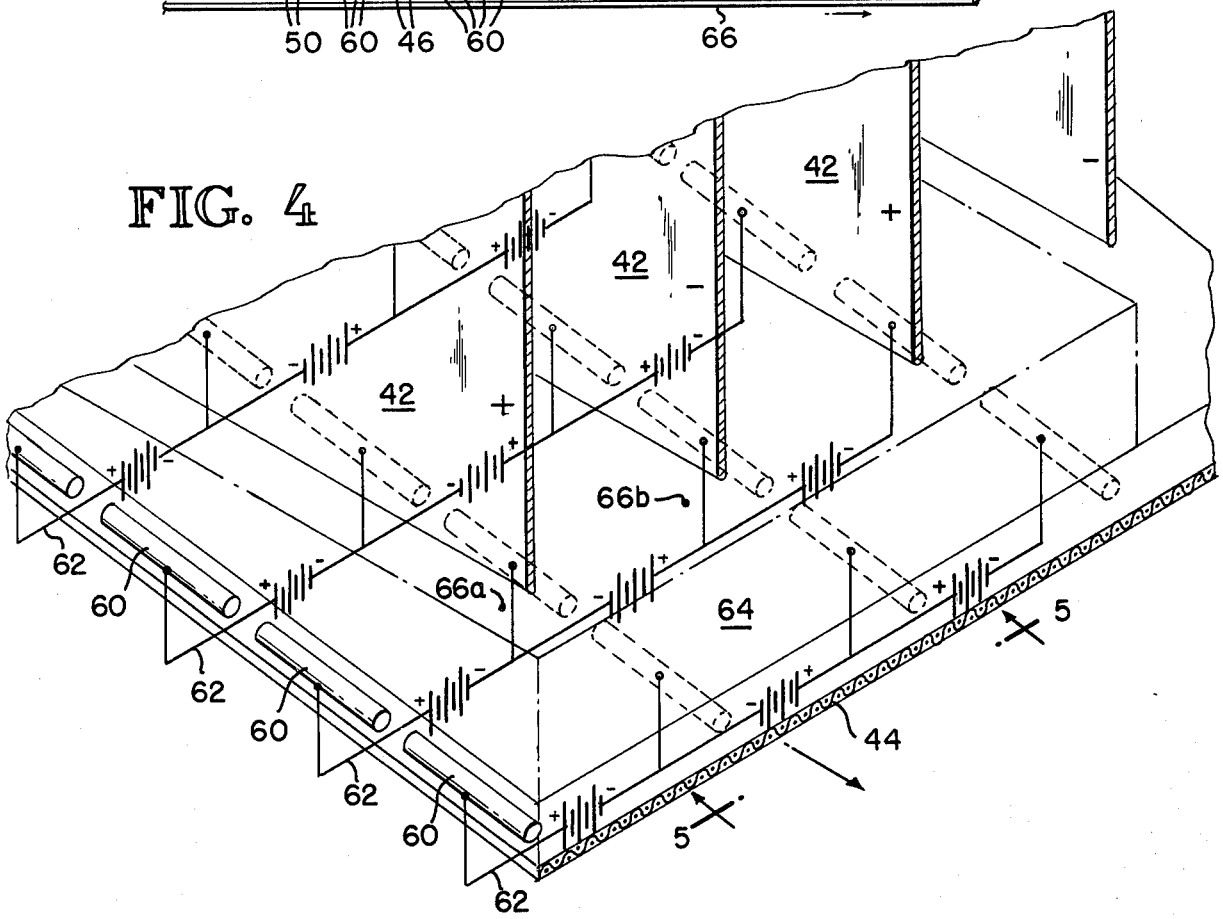
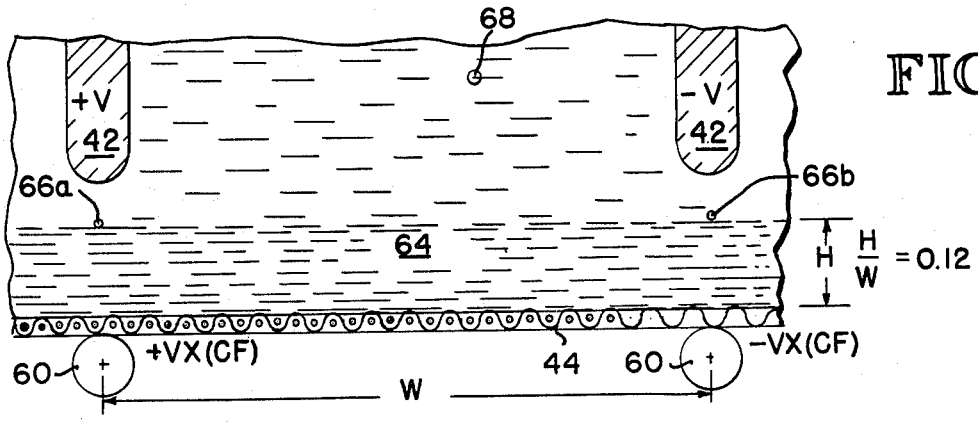
FIG. 5

METHOD AND APPARATUS FOR THE ELECTROSTATIC ORIENTATION OF PARTICULATE MATERIALS

DESCRIPTION

1. Technical Field

This invention relates to a method and apparatus for the formation of a mat of directionally oriented pieces of particulate fibrous material, such as wood fiber, flakes and strands, synthetic fiber, proteinaceous fiber, and glass fiber, into a mat of directionally oriented material.

2. Background Art

Useful directional strength and stiffness properties of panels, boards, or other like products can be enhanced by directionally orienting the discrete, elongated pieces of lignocellulosic material making up the panels or boards prior to their being pressed in the various known processes of reconstituting particulate matter into panels, boards, or other shapes. Considerable effort and research have been conducted to develop commercially attractive techniques for directionally orienting small pieces of lignocellulosic material during formation of a mat and to maintain the orientation. Orientation has been carried out by two principal means: (1) mechanical and (2) electrical or electrostatic. At the present time, reconstituted wood panels or particleboard materials are being formed for the commercial market by mechanical orientation of small pieces of lignocellulosic material. It has also been determined that products of commercial quality can be formed utilizing electrostatic techniques, some of which are described in U.S. Pat. Nos. 3,843,756 and 4,113,812. Referring to FIG. 4 of U.S. Pat. No. 4,113,812, a technique is shown which has been developed to commercial acceptability. It was noted, however, that when the depth of the mat being formed was increased to form a thicker product, severe distortions of the electric field above the mat occurred, even though the electrical contacts made with the mat caused current to flow in the mat being formed. Similar distortion was noted when the width between spaced, charged electrode plates was reduced with respect to the mat depth for orientation of the discrete pieces at substantially right angles to the direction of travel of the mat being formed.

This application is directed to means of continually adjusting the strength of the electric field through the formed mat along its length to achieve a more uniform surface potential distribution at the upper surface of the mat being formed, thereby reducing the distortion of the electric field immediately above the mat.

This invention is also applicable to the orientation of fibrous materials other than lignocellulosic materials, including proteinaceous fiber (soybean), synthetic fiber (nylon, polyester, acrylonitrile) and glass or other inorganic fiber. The material employed should have, or be pretreated, to have sufficient electrical conductivity when formed into a mat to allow an electric current to flow through the mat.

DISCLOSURE OF THE INVENTION

A method and apparatus are disclosed for forming a mat of directionally oriented fibrous material comprising depositing a multitude of discrete pieces of material on a mat-support surface in a forming zone, causing an electric current to flow through the deposited mat to produce a directional electric field immediately above the mat in the direction of desired orientation of the material, and varying the strength of the electric field along the length of the mat being formed to yield a potential distribution on the upper surface of the mat approximately equal to the potential distribution resulting from using spaced, charged electrode plates located immediately above the mat between which the multitude of discrete pieces is allowed to free-fall for orientation before deposit on the mat-support surface. The mat-support surface is preferably a cribriform insulating material. Electric current is caused to flow through the mat formed on the mat-support surface by spaced electrical contact electrodes making contact with the lower surface of the mat support structure. Electric current is conducted through the moving mat-support surface by corona discharges through the interstices of the mat-support surface. The contact electrodes making contact with the lower surface of the mat-support structure, in the case of cross-orientation of the pieces to the direction of movement of the mat-support surface, are segmented in the direction of travel of the mat-support surface. The voltage applied to each of the electrode segment pairs is selected to yield a potential distribution at the upper surface of the mat which approximately equals the potential distribution between the spaced, charged electrode plates located immediately above the forming mat. By continuously adjusting the strength of the electric field along the length of the mat-support surface as the thickness of the mat is increased, severe distortions of the electric field are avoided and a mat of more uniform orientation is obtained.

It is thus a principal object of this invention to achieve a suitable electric field configuration above the forming mat by varying the voltages applied to the mat to achieve a desired surface potential distribution at the top surface of the mat.

A further object of this invention is to provide a method for orienting elongated pieces of electrically conductive fibrous material in a direction at right angles to the direction of travel of the mat-support surface or at some other angle without objectionable distortion of the electric field and without the plate-shadow effect, which occurs when a multiplicity of electric field-producing conductive plates are used above the mat in the orientation of pieces at right angles to the direction of travel of the mat-support surface.

A further object of the invention is to provide a method and apparatus for formation of a continuous mat of oriented discrete pieces of lignocellulosic material which are economical and reliable.

BRIEF DESCRIPTION OF THE DRAWINGS

FIG. 3 is a schematic side view of a cross-orientation cell for cross-orientation of discrete pieces of material for deposition on a transfer surface for transfer to a moving mat-receiving surface.

FIG. 4 is a perspective view of three orienting cells of a cross-machine-direction orienting apparatus illustrating the wedge-shaped forming mat resting on a horizontal, moving mat-support surface which is in contact with segmented contact electrodes.

FIG. 5 is a vertical, cross-sectional view along section line 5—5 of FIG. 4 showing the orienting zone defined by positive and negative electrodes, with the movement of the mat-support surface being out of the paper.

BEST MODE FOR CARRYING OUT THE INVENTION

The method and apparatus described herein are directed to both in-line (machine-direction) orientation and cross-machine orientation of discrete, elongated, individual pieces of material, such as lignocellulosic flakes, strands, chips, wafers, shavings and slivers, proteinaceous fibers such as soybean fiber, synthetic fibers such as nylon polyester, acrylic, etc., and inorganic fiber such as glass. It may be necessary to coat the fibers of certain synthetic and inorganic fibers with an electrically conductive coating in order to render them sufficiently conductive to conduct an electric current through the mat of fibers.

Hereafter, particular reference is made to orientation of lignocellulosic material; however, the method and apparatus can be similarly used for other fibrous materials.

Figure 1:
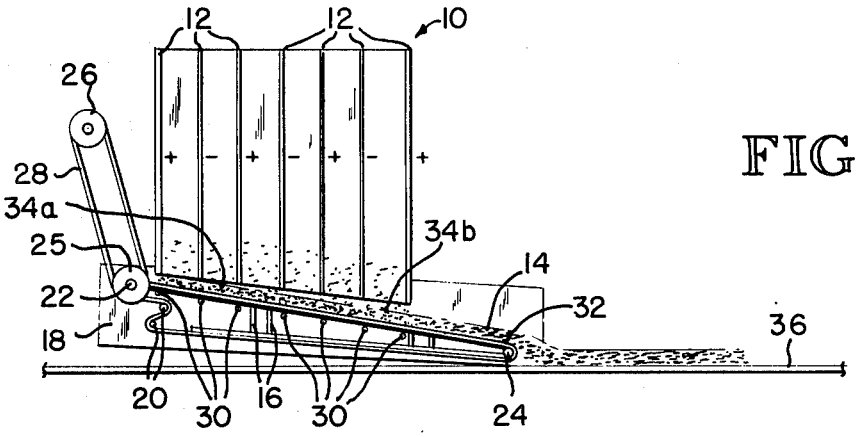
FIG. 1 is a schematic side view of an in-line apparatus for forming a mat of discrete pieces of material oriented in the machine direction.
Figure 2:
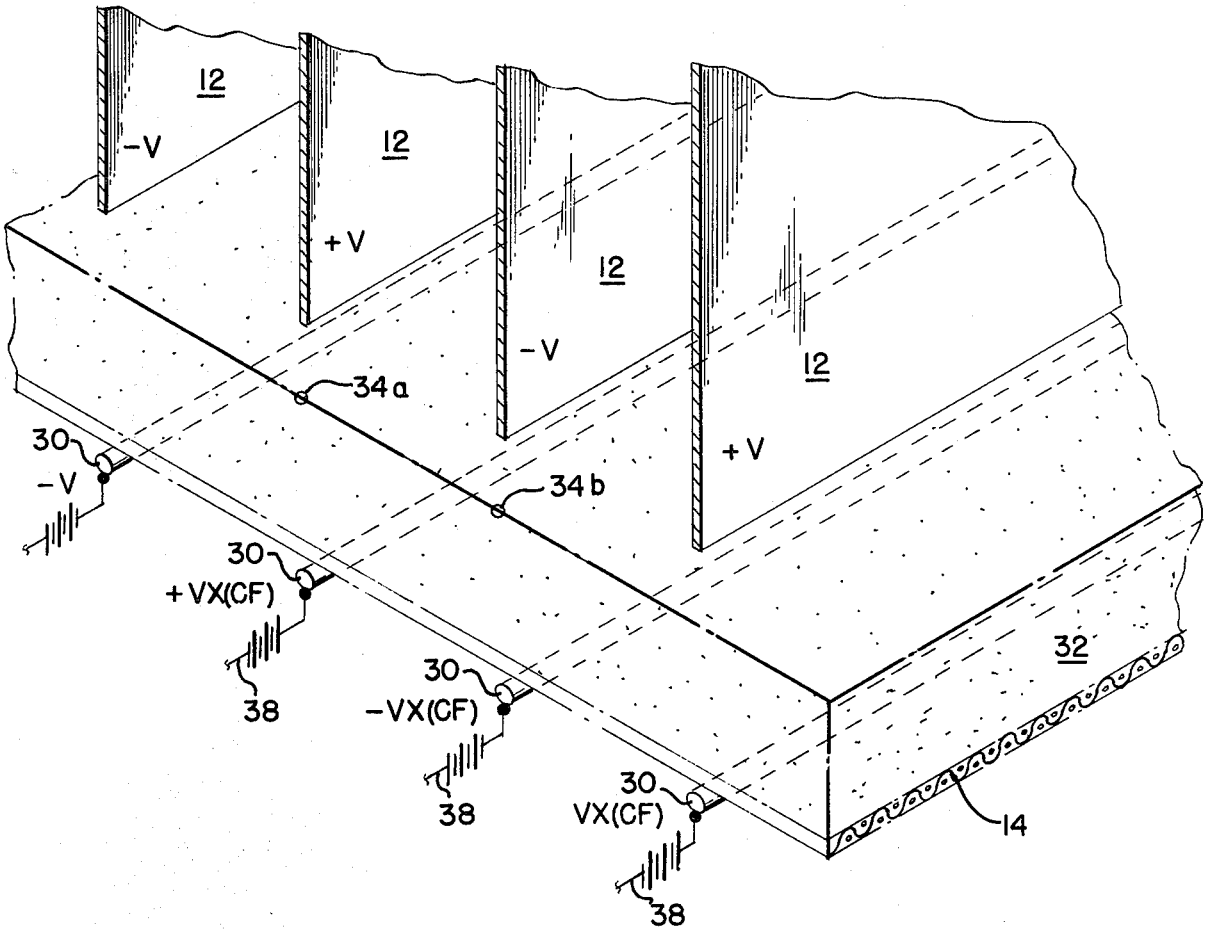
FIG. 2 is a perspective view of three orienting cells of an in-line orienting apparatus illustrating the wedge-shaped forming mat resting on a horizontal, moving mat-support surface which is in contact with contact electrodes.

Reference is made to co-pending U.S. patent application Ser. No. 230,691, filed Feb. 2, 1981, now U.S. Pat. No. 4,347,202 entitled "Method for Production of Directionally Oriented Lignocellulosic Products, Including Means for Cross-Machine Orientation," for a description and discussion of an installation for forming a composite, multilayered mat of electrostatically aligned lignocellulosic pieces, both in the machine and cross-machine directions. FIGS. 1 and 2 of this application illustrate schematically an orientation cell for in-line orientation of discrete fibers, i.e., pieces oriented in the direction of movement of the caul belt supporting the formed mat of such discrete pieces. FIGS. 3 and 4 of this application illustrate schematically an orientation cell for orienting discrete pieces of material at substantially right angles to the direction of movement of the caul belt on which the formed mat is supported.

Referring to FIG. 1, an orientation cell 10 is schematically illustrated for electrostatically orienting discrete pieces of material cascaded by gravity between the vertically aligned and electrically charged electrode plates 12. Each plate is charged with an appropriate potential, alternately positive and negative, such that an electric field is established between the adjacent plates to electrostatically align the pieces in the machine direction as they free-fall by gravity through the orientation cell. As they descend through the spaced electrode plates, the pieces align their lengthwise direction with the direction of the electric field formed between each adjacent pair of plates and are deposited on a cribriform insulating belt 14 (i.e., a belt having small perforations) which travels over an inclined support frame 16. End plates 18 form the sidewalls of the orientation cell. The belt 14 is a continuous endless belt trained about idler rolls 20, drive roll 22 and nosepiece 24. The cribriform belt 14 is driven by a motor (not shown) driving sprocket 26 connected to drive roll sprocket 25 by belt 28. The drive roll sprocket 25 is keyed to the drive roll 22. Electrodes 30 are located directly beneath the belt 14 and are in direct contact with the belt. Each electrode 30 is charged with an electric potential of the same polarity as an electrode plate 12 directly above it. Each lower electrode is connected to a source of electrical potential, such as a battery. On passage of electric current through the mat 32 formed on the belt 14, the spaced electrodes 30 produce a directional electric field immediately above the mat which is predominantly parallel with the surface of the belt and which is predominantly directed in the machine direction. The electric current flows through the mat by corona-discharge contact of the mat with the spaced electrodes placed beneath the belt 14, each electrode having applied thereto a voltage sufficient to cause an electric current to flow through the belt, and thence through the mat between the electrodes in the desired direction to produce the desired electric field. Even though the electrical contacts with the forming mat causes current to flow in the forming mat to orient material, severe distortions of the electric field take place when either the cell width is reduced or the thickness of the mat increases. Excellent performance is demonstrated when the mat thickness is relatively small with respect to the width of the orientation cell.

To overcome the distortions occurring as the thickness of the mat 32 formed on the belt 14 increases toward the discharge end of the orientation cell, potentials impressed on the electrodes 30 are chosen such that the mat surface potentials (voltage) at points 34*a* and 34*b* (FIG. 2) correspond essentially to the electrode potential directly above each of those points on the spaced, charged electrode plates 12. FIG. 2 illustrates a series of electrodes 30, each charged with a voltage multiplied by a compensation factor such that the mat surface potentials at points 34*a* and 34*b* match essentially with the potentials on the corresponding charged plates 12. The mat 32, as formed, is deposited on a caul belt 36 (FIG. 1) which carries the oriented mat to a press or other processing location.

FIGS. 3 and 4 illustrate schematically an orientation cell for orientation of the discrete pieces at substantially right angles to the direction of movement of the insulating belt on which the mat of discrete pieces is deposited. The orientation cell 40 for cross-orientation includes a plurality of vertically aligned, electrically charged, spaced plates 42 extending parallel to the direction of movement of the insulating belt 44 on which the discrete pieces are deposited. Each of the vertical plates 42 is charged with an appropriate potential such that an electric field is established between adjacent electrode plates which is substantially at right angles to the direction of movement of the belt 44. This field electrostatically aligns the pieces with their length direction extending in the cross-machine direction as they freely fall through the orientation cell. The oriented pieces descending through the orientation cell are deposited on a cribriform insulating belt 44 of a type similar to that described with regard to the in-line orientation cell 10. The belt runs over inclined belt supports 46. End plates 48 are spaced apart essentially the width of the orientation cell to form the sidewalls of the cell. The belt 44 is trained about idler rolls 50, drive roll 52 and nosepiece 54. Drive roll 52 is driven by a motor (not shown) through sprocket 56, belt 58 and sprocket 59. Segmented electrodes 60 are located beneath the belt and in contact with the belt. Each electrode is connected to a suitable source of electricity 62, such as a battery. Each segmented electrode is located directly beneath its respective spaced, charged plate 42, as illustrated in FIG. 4, and is charged with a polarity essentially the same as the corresponding electrode plate. The mat 64, as it is formed, is discharged from the belt 44 onto a caul belt 66.

As with the machine-direction orientation cell 10, the mat increases in thickness on the cross-machine cell's belt as it moves toward the discharge end of the cell 40. When the width of the orientation cell is reduced, the electric field is distorted to such an extent that wind rows of the deposited pieces form directly beneath each of the upper electrodes and valleys are formed toward the center of the spacing between adjacent plates. To overcome this problem, U.S. patent application Ser. No. 230,691, referred to previously, discloses arranging the upper electrodes to include a series of angled sections or a chevron pattern to redistribute continuously the distortions over the full width of the mat being formed. Although use of a chevron pattern of electrodes is one way of overcoming the problem created by distortion of the electric field, it does not solve the problem but merely distributes the effects of the distortions over the entire width of the mat being formed. As previously noted with the machine-direction orientation cell 10, when the mat thickness increases or when the cell width is reduced, severe distortions of the electric field take place, resulting in the problems previously alluded to, including inadequate orientation of the pieces and uneven distribution of the pieces across the width of the mat being formed, i.e., wind rows and valleys. Even though the electrical contacts made by electrodes 60 with the forming mat 64 were excellent and caused the current to flow in the forming mat, the distortions in the electric field were still present.

Referring to FIGS. 3 and 4, each electrode 60 is segmented in the direction of movement of the belt 44 such that each pair of electrodes is provided with a potential different from that of the previous electrode pair, the difference being a compensation factor chosen such that the upper mat surface potentials at points 66*a* and 66*b* correspond essentially to the potential between the charged electrode plates 42.

The magnitude of the voltage gradient between the spaced electrode plates in both the machine-direction and cross-orientation cells and that between the respective electrodes located beneath the cribriform belt (i.e., electrode 60 in the cross-machine orientation cell and electrode 30 in the machine-direction orientation cell) may vary, depending on numerous factors, such as the type, size, shape, moisture content and electrical conductivity of the material being used. Generally, the voltage gradients range between 1 kv/in and 12 kv/in for lignocellulosic materials. Preferably, a direct current is supplied to each electrode, although alternating current may be used.

FIG. 5 illustrates a partial cross-sectional view along section 5—5 of FIG. 4. Referring to FIG. 5, an electrode 60 beneath the positively charged electrode plate 42 is impressed with a positive voltage times a compensation factor to achieve the desired field and the corresponding electrode 60 beneath the negatively charged electrode plate 42 is impressed with a negative voltage of equal magnitude times the desired compensation factor. The belt 44 rests on the electrodes 60 and is generally comprised of a woven or perforated insulating material. Electric current is conducted through the moving belt 44 to the mat 64 by corona discharges through the interstices of the woven or perforated belt. The compensation factor (CF) is chosen such that the mat surface potentials at points 66*a* and 66*b* correspond to the potential on the respective positively charged and negatively charged electrode plates 42. Descending pieces of material 68 experience electric field forces which tend to align them in the direction of the electric field in the orienting zone between the charged electrode plates 42 and above the surface of the mat 64.

Figure 6:
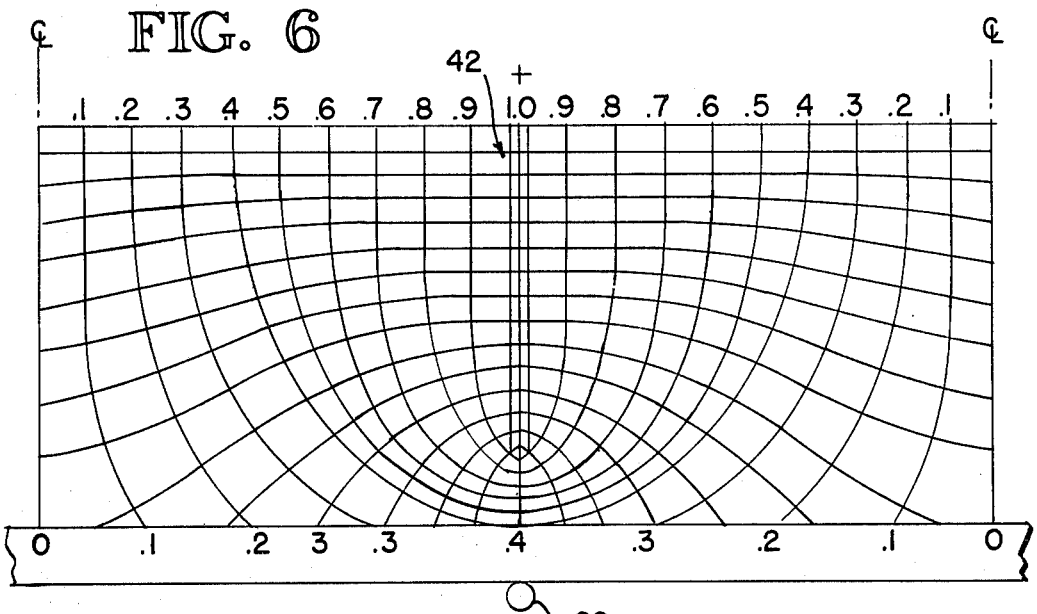
FIG. 6 is a vertical, transverse, half cross-section of an orienting zone in which the depth-to-width ratio (H/W) of the mat is $\frac{1}{3}$ and the compensation factor (CF) is set to 1.0.

FIG. 6 is a schematic representation of a vertical, transverse cross-section of an orienting cell and the electric field configuration in the orienting cell in which the depth-to-width ratio (H/W) of the mat being formed is 1:3, and the compensation factor (CF) is set to 1.0. In this example, the lower contact electrodes 60 are supplied with a voltage equal to the voltage supplied to the charged plates 42. The electric field is increasingly distorted as the edge of the orientation cell is approached. Under these conditions, the elongated pieces of material become oriented in almost a vertical direction underneath each upper electrode plate 42 and are attracted to the higher electrical field near the lower corner of each upper electrode plate. This electric field distortion results in wind rowing of the pieces under the upper electrodes and formation of valleys at other places along the width of the mat, resulting in an overall uneven distribution of pieces making up the mat and less than optimum orientation.

Figure 7:
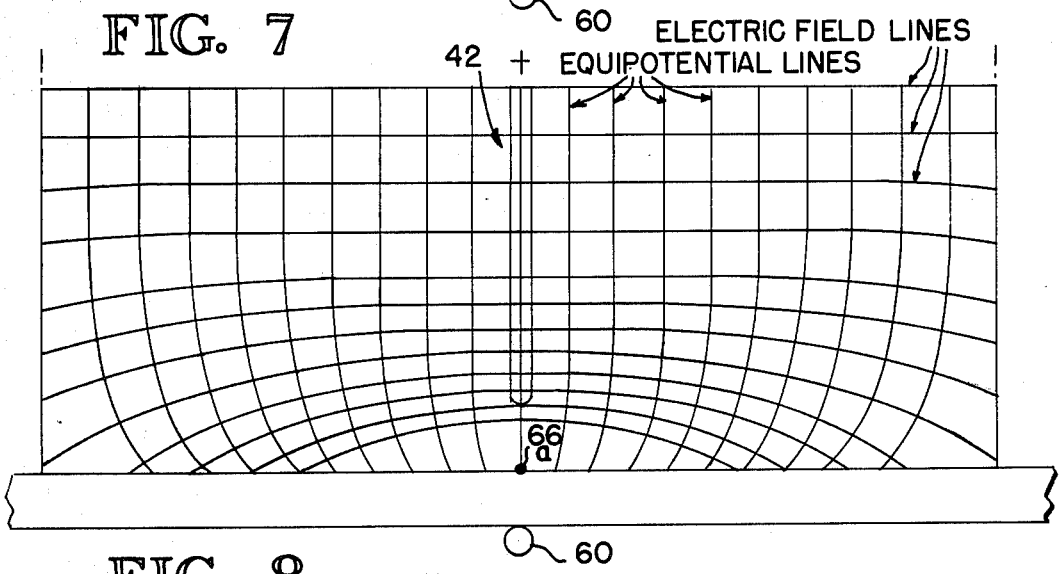
FIG. 7 is a vertical, transverse, half cross-section drawing of an orienting zone depicting the electric field in which the depth-to-width ratio (H/W) of the mat is $\frac{1}{3}$ and the compensation factor (CF) is set to 2.793.

FIG. 7 is a schematic representation of a vertical, transverse, cross-section of an orienting cell and the electric field configuration in the orienting cell in which the depth-to-width ratio (H/W) of the mat being formed in 1:3 and the compensation factor (CF) is 2.793. Under these conditions, the surface potential of the mat (referring to FIG. 4) at point 66*a*, directly underneath the upper electrode 42, is equal to the potential on the plate electrode 42 directly above. The fringing field under each upper electrode is thereby essentially eliminated and the electric field in the orienting zone is nearly uniform (as horizontal as it can be made with the array of electrodes and potentials applied).

Figure 8:
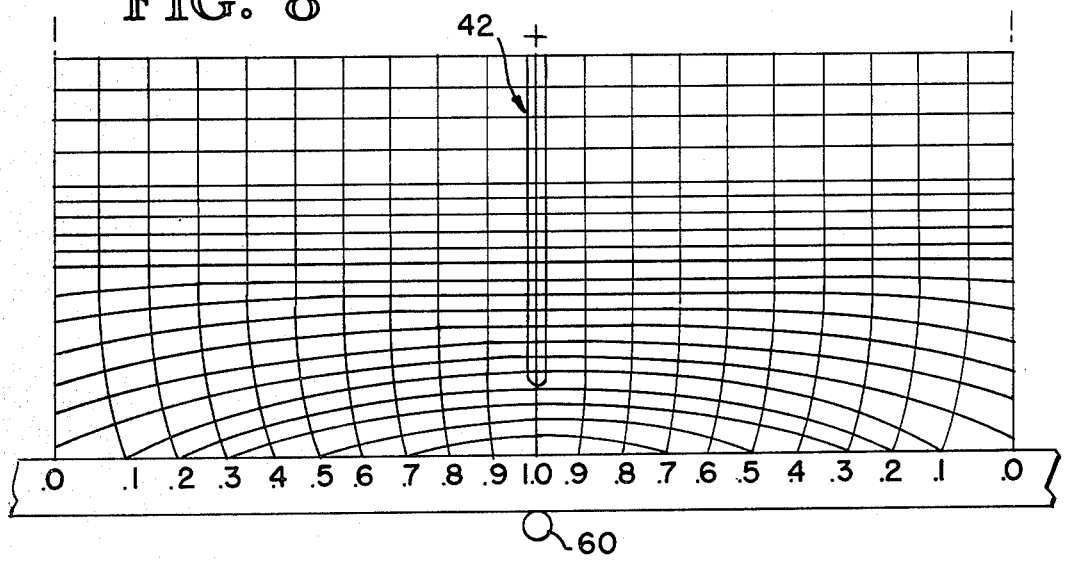
FIG. 8 is a vertical, transverse, half cross-section drawing of an orienting zone depicting the electric field in which the depth-to-width ratio (H/W) of the mat is 1/6 and the compensation factor (CF) is set to 1.567.

FIG. 8 is a schematic representation of a vertical, transverse, cross-section schematic of an orienting zone and the electric field configuration of the orienting zone in which the depth-to-width ratio (H/W) is 1:6, and the compensation factor (CF) is set to 1,567. Using a lower depth-to-width ratio, the problem of compensation of the surface potentials is greatly reduced and the resulting electric field, after compensation, is more nearly horizontal throughout the orienting zone. This figure illustrates the advantage of operating equipment having small values of H/W with the electrode potential adjusted for the most beneficial configuration of the electric field. A further advantage arises from using a smaller value for the compensation factor as, in most cases, the maximum potential that can be applied to the equipment is limited by electrical breakdown conditions in the equipment. A smaller compensation factor allows higher voltages to be used for the upper electrodes, stronger electric fields to be produced, and stronger orienting forces to be applied to align the discrete pieces of material. If a large compensation factor is necessary, the potential that can be applied to the plates is, of practical necessity, reduced either to prevent excessive corona discharge or to prevent electrical breakdown somewhere within the equipment.

I claim:

1. A method of forming a mat of directionally oriented discrete pieces of material on a mat-support surface, comprising depositing a multitude of the discrete pieces of material on the mat-support surface in a mat-forming zone, causing an electric current to flow through the deposited mat to produce a directional electric field immediately above the mat in the direction of desired orientation of the pieces, the electric field tending to cause the pieces to orient their length dimensions in the direction of the electric field, and varying the strength of the electric field along the length of the mat-support surface in the direction of material flow thereof to achieve a desired surface potential distribution at the upper surface of the mat as the thickness of the mat being formed increases.

2. The method of claim 1 wherein the electric current is caused to flow through the deposited mat by charged electrically conductive elements positioned beneath the mat-support surface and wherein the mat-support surface is a cribriform insulating material, the electric current conducted through the mat-support surface by corona discharges through interstices in the mat-support surface.

3. The method of claim 2 wherein the electrically conductive elements are each charged with an electric potential increased by a compensation factor as the thickness of the mat is increased to maintain the electric field along the upper surface of the mat substantially uniform.

4. The method of claim 1 wherein the potential applied to the bottom surface of the mat along the length of the mat-forming zone is a continuously variable value and wherein the electric current caused to flow through the mat is varied to substantially equalize the electric field along the upper surface of the mat within the mat-forming zone.

5. A method of preventing severe distortion of the electric field in the electrostatic orientation of a multitude of discrete elongated pieces of lignocellulosic material deposited on a mat-support surface in a mat-forming zone to form a mat of oriented pieces with their length dimensions oriented in the direction of the electric field, the severe distortion resulting in reduced alignment of the pieces, comprising:

causing an electric current to flow through the deposited mat of oriented pieces to produce a directional electric field above the mat in the direction of desired orientation of the pieces, the electric field tending to cause the individual pieces to orient their length dimensions in the direction of the electric field, and varying the strength of the electric field by increasing the strength of the applied electrical potential as the thickness of the mat formed on the mat-support surface is increased to maintain the electric field at the upper surface of the mat being formed substantially equal along the entire length of the mat-forming zone.

6. The method of claim 5 wherein the electric current caused to flow in the mat is varied along the length of the mat-forming zone to substantially equalize the mat surface electric field to that of an orienting zone located above the mat-support surface through which the individual discrete pieces of lignocellulosic material free-fall by gravity for initial orientation.

7. The method of claim 6 wherein the mat-support surface is a cribriform insulating material and the electric current in the mat is induced by electrically charged conductive elements positioned beneath the mat-support surface and in contact therewith.

8. The method according to claim 7 wherein the electrically conductive elements are each charged with an electric potential incrementally greater than the previous electrode relative to the direction of material flow of the mat so as to equalize the surface electric field over the upper surface of the mat being formed as the mat increases in thickness.

9. A method of achieving improved surface potential distribution in the production of a mat of oriented fibers by electrostatic orientation, comprising:

providing a high-voltage orienting zone generating a directional electric field for alignment of individual discrete fibers, cascading a multitude of the fibers through the orienting zone for electrostatic alignment thereof with their longer dimension generally parallel to the electric field lines within the orienting zone, moving a cribriform, insulating, mat-receiving surface below the orienting zone to receive the cascading aligned particles thereon to form a continuous mat, causing an electric current to flow within the mat formed on the mat-receiving surface to produce a directional electric field immediately above the mat substantially parallel to the electric field of the orienting zone, and varying the electric current caused to flow through the mat along the length of the mat being formed to substantially equalize the surface electric field at the upper surface of the mat being formed with the electric field of the orienting zone.

10. Apparatus for forming a mat of directionally oriented discrete pieces of material on a mat-support surface, comprising:

an orienting zone having a first directional electric field for electrostatically orienting a multitude of such discrete pieces passing therethrough in the direction of the electric field, a cribriform, insulating, mat-support surface positioned beneath the orienting zone receiving the aligned discrete pieces thereon to form a mat, means producing a directional electric field immediately above the mat formed on the mat-support surface parallel to the direction of the electric field of the orienting zone, and means for varying the strength of the electric field produced immediately above the mat so as to substantially equalize the surface electric field along the upper surface of the mat with the electric field of the orienting zone as the thickness of the mat increases.

11. The apparatus of claim 10, including means for moving the mat-support surface beneath the orienting zone.

12. The apparatus of claim 10 wherein the orienting zone includes a plurality of vertically extending, spaced-apart, electrically conductive plates, with adjacent plates charged with opposite electric potentials to provide an electric field between for electrostatic alignment of pieces to be deposited on the mat-support surface, the plates in substantially parallel alignment with each other.

13. The apparatus of claim 10 wherein the means for varying the electric field includes a series of electrically conductive elements positioned beneath the cribriform mat-support surface directly beneath each of the vertically charged plates, and means to impress the conductive elements with an increasing electrical potential to substantially equalize the surface electric field along the upper surface of the mat being formed as the thickness of the mat increases.

14. The apparatus of claim 13 wherein the spaced electrically conductive plates of the orienting zone extend substantially in the direction of movement of the mat-support surface and wherein the conductive elements placed directly beneath each of the vertically extending, electrically conductive plates are segmented into a plurality of separate electrodes positioned parallel to the direction of motion of the mat-support surface, each segmented electrode being impressed with an electrical potential greater than the previous electrode segment.

15. The apparatus of claim 14 wherein the electrically conductive plates of the orienting zone extend at substantially right angles to the direction of movement of the mat-support surface and the electrically conductive elements extend parallel to and directly beneath each of the vertically extending, spaced-apart, conductive plates, the elements segmented in the direction of movement of the mat being formed; means impressing each conductive element segment with an electrical potential greater than the previous electrically conductive element segment, beginning at one end and moving in the direction of discharge of the mat being formed.

16. The apparatus of claim 15 wherein the electrical potentials impressed on the conductive elements are such as to equalize the surface potential distribution along the upper surface of the mat to that existing between the plate electrodes in the orienting zone above the mat being formed.

* * * * *